US010283263B2

(12) United States Patent
Tridico et al.

(10) Patent No.: US 10,283,263 B2
(45) Date of Patent: May 7, 2019

(54) IGNITION COIL

(71) Applicant: BorgWarner Ludwigsburg GmbH, Ludwigsburg (DE)

(72) Inventors: Francesco Tridico, Asperg (DE); Timo Stifel, Stuttgart (DE); Manfred Adolf, Schwaikheim (DE); Dirk Wüstenhagen, Auma (DE); Sven Schumm, Walheim (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 15/654,081

(22) Filed: Jul. 19, 2017

(65) Prior Publication Data

US 2018/0025836 A1 Jan. 25, 2018

(30) Foreign Application Priority Data

Jul. 21, 2016 (DE) ..... 10 2016 113 451

(51) Int. Cl.

| | |
|---|---|
| ***F02B 77/00*** | (2006.01) |
| ***H01F 38/12*** | (2006.01) |
| ***F02P 3/04*** | (2006.01) |
| ***H01T 13/04*** | (2006.01) |
| *F02P 3/02* | (2006.01) |
| *H01R 13/53* | (2006.01) |

(52) U.S. Cl.

CPC ..... *H01F 38/12* (2013.01); *F02P 3/04* (2013.01); *H01T 13/04* (2013.01); *F02P 3/02* (2013.01); *H01R 13/53* (2013.01)

(58) Field of Classification Search

CPC .. H01F 38/12; H01T 13/04; F02P 3/04; F02P 3/02; H01R 13/53

See application file for complete search history.

(56) References Cited

U.S. PATENT DOCUMENTS

| | | | | |
|---|---|---|---|---|
| 6,191,674 | B1 | 2/2001 | Adachi et al. | |
| 8,225,775 | B1 | 7/2012 | Idogawa et al. | |
| 9,728,322 | B2 * | 8/2017 | Sano | F02P 1/083 |
| 2015/0022304 | A1 | 1/2015 | Skinner et al. | |

FOREIGN PATENT DOCUMENTS

| | | | |
|---|---|---|---|
| DE | 298 15 475 | U1 | 12/1998 |
| DE | 10 2005 005 057 | B4 | 6/2010 |
| DE | 10 2013 101 302 | A1 | 8/2014 |
| EP | 0 951 026 | A2 | 10/1999 |
| JP | H04-64207 | A | 2/1992 |
| JP | 2008-034682 | A | 2/2008 |
| JP | 2009-123838 | A | 6/2009 |
| JP | 2011-134857 | A | 7/2011 |

* cited by examiner

*Primary Examiner* — Hung Q Nguyen

(74) *Attorney, Agent, or Firm* — Bose McKinney & Evans LLP

(57) ABSTRACT

Described is an ignition coil for an internal combustion engine having a housing with a plug connector, wherein the plug connector has an elastomeric cap slid onto a tubular housing section that surrounds a terminal contact. This disclosure provides that the terminal contact is surrounded by a circumferential slot, in which an inner edge of the cap sits.

10 Claims, 2 Drawing Sheets

IGNITION COIL

RELATED APPLICATIONS

This application claims priority to DE 10 2016 113 451.1, filed Jul. 21, 2016, the entire disclosure of which is hereby incorporated herein by reference in its entirety.

BACKGROUND

The invention relates to an ignition coil generally of the type disclosed in U.S. Pat. No. 6,191,674 B1.

The electrical connection of an ignition coil to a spark plug is made by a plug connector, into which a sparkplug is inserted. This plug connector can have an elastomeric cap, which is slid onto a tubular housing section. An elastomeric cap can seal the plug connection with the spark plug against moisture, and impede high-voltage discharges.

SUMMARY

This disclosure teaches how the dielectric strength of the plug connector of an ignition coil can be improved.

In an ignition coil according to this disclosure, the terminal contact of the plug connector that is slid onto a spark plug is surrounded by a circumferential slot, in which an inner edge of a circular elastomeric cap sits, which is slid onto a tubular housing section of the ignition coil. In this way, the creepage distance from the terminal contact to the external side of the cap can be lengthened. This leads to an increased dielectric strength.

The increased dielectric strength makes it possible to shorten the plug connector as it is no longer necessary to insert the spark plug so deep into the plug connector. The less far the spark plug is inserted into the plug connector, the shorter the creepage distances, and then the lower the dielectric strength. The circumferential slot, which surrounds the terminal contact and in which sits an inner edge of the elastomeric cap, makes it possible to ensure a sufficiently large creepage distance, and hence a sufficient dielectric strength, even given a shortened plug connector. The cap may fill the circumferential slot completely or almost completely, for example it may fill out ⅘ of the circumferential slot volume or more. However, this is not required for achieving a lengthened creepage distance.

An advantageous refinement of this disclosure provides that the terminal contact be inserted in an electrically insulating sleeve, and that the circumferential slot be formed between the electrically insulating sleeve and an internal surface of the tubular housing section. This facilitates production.

The sleeve preferably ends flush with the terminal contact, or projects over and beyond it opposite the plugging direction, i.e., toward a spark plug inserted into the plug connector. As a result, the creepage distance can be further lengthened.

Another advantageous refinement of this disclosure provides that the sleeve has a collar, for example a thickened section that abuts against the interior side of the housing. From a production standpoint, this makes it very easy to form the circumferential slot, e.g., by inserting the sleeve into the housing. For example, the sleeve can be pressed into the housing.

Another advantageous refinement of this disclosure provides that the elastomeric cap is made out of silicone.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
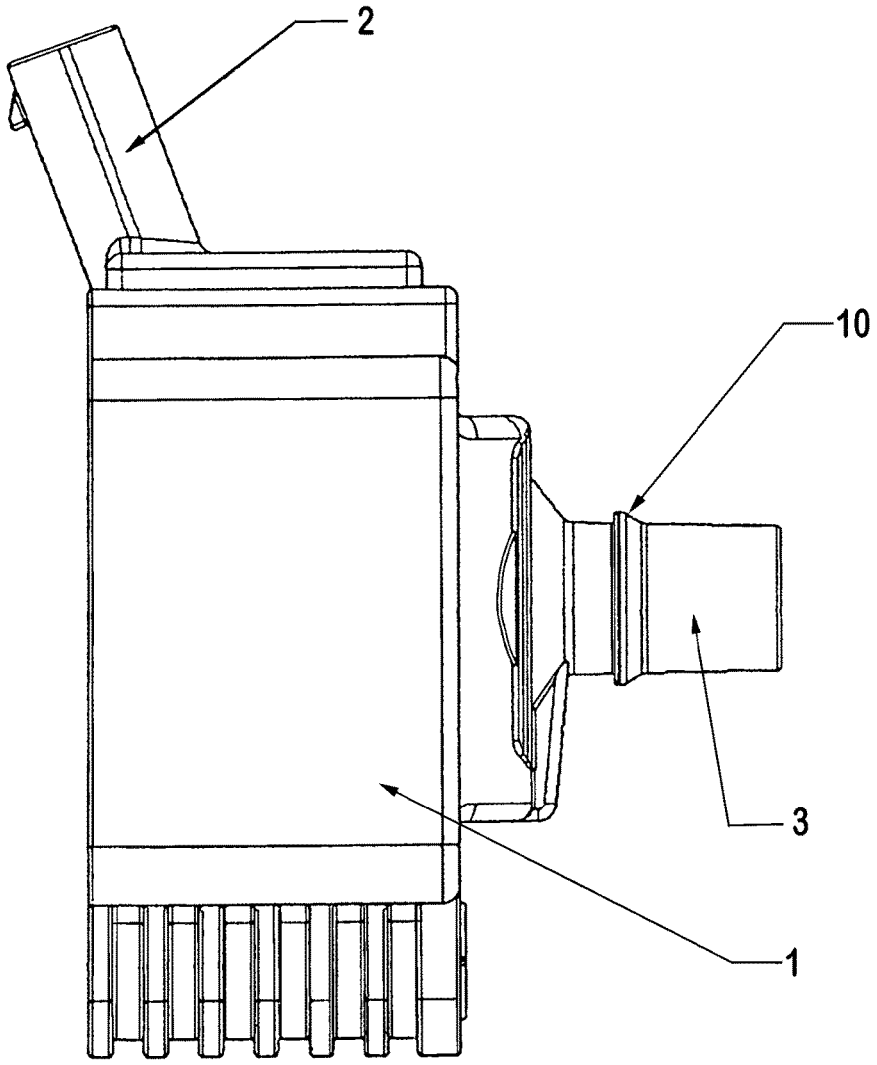
FIG. 1 is a schematic view of an ignition coil without cap.

The ignition coil shown on FIG. 1 comprises a housing 1, in which is arranged a transformer, which provides an output voltage for a spark plug from an input voltage, which may for example be provided by the electrical system of a vehicle. The ignition coil comprises a first plug connector 2 for connection to a power source, for example the electrical system of a vehicle, and a second plug connector 3 for sliding onto a spark plug. The plug connector 3 forms a dome-like high-voltage terminal. The interior side of the high-voltage terminal is sometimes referred to as a dome.

Figure 2:
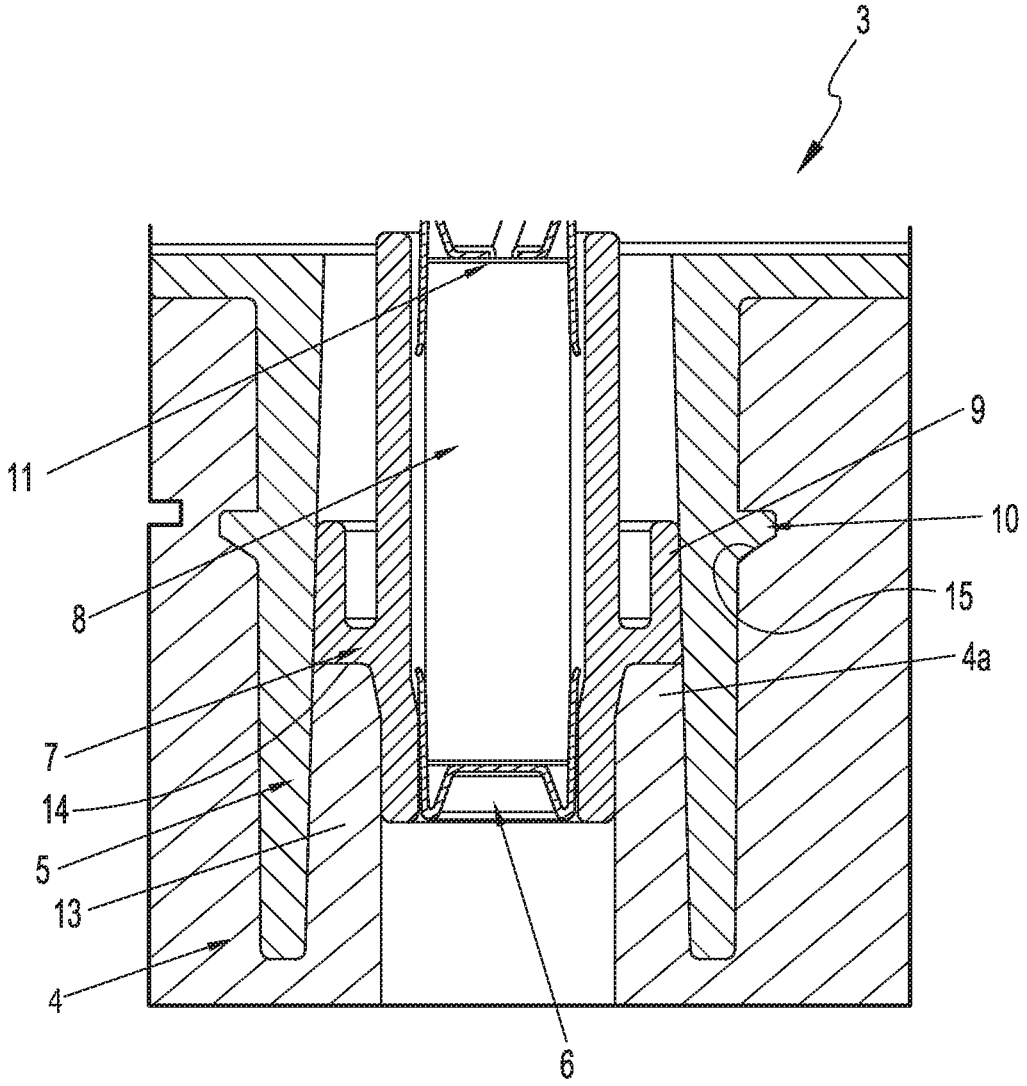
FIG. 2 shows a sectional view of a detail of the ignition coil.

FIG. 2 shows the plug connector 3 configured for receiving a spark plug in a cut detailed view together with an attached elastomeric cap 4. The circular elastomeric cap 4 is attached to a tubular housing section 5, which surrounds a terminal contact 6. The terminal contact 6 is surrounded in the tubular housing section 5 by a circumferential slot 13, into which the cap 4 projects.

As shown on FIG. 2, the cap 4 essentially fills out the circumferential slot completely. An inner edge 4*a* or rim of the circular cap 4 is thus arranged in the circumferential slot. The cap 4 can touch the floor 14 of the circumferential slot, as depicted on FIG. 2, or end a distance away from it, thereby leaving a free space on the floor of the circumferential groove.

The circumferential groove in combination with the cap 4, which may consist, e.g., of silicone, causes the creepage distance to lengthen from the terminal contact 6 to the exterior side of the cap 4. As a result, the tubular housing section 5 or the plug connector 3 can be shortened, without detracting from the dielectric strength in the process.

The terminal contact 6 sits in an electrically insulating sleeve 7. The circumferential slot into which the elastomeric cap 4 projects is formed between the electrically insulating sleeve 7 and an inner surface of the tubular housing section 5. In the embodiment shown, the sleeve 7 ends flush with the terminal contact 6, but can also project over and beyond it.

An interference resistor 8 can be arranged in the electrically insulating sleeve 7. The terminal contact 6 can be designed as a metal cap of the interference resistor 8. At its opposite end, the interference resistor 8 can carry another metal cap 11, which secures it to the transformer of the ignition coil.

The electrically insulating sleeve 7 can be pressed into the tubular housing section 5. In order to make it easier to secure the sleeve 7 in the tubular housing section 5, the sleeve 7 can have a thickened section, for example a bead 9, which abuts against the tubular housing section 5 on the inside.

The exterior side of the tubular housing section can have a continuous projection 10, which engages into a circumferential slot or groove of the elastomeric cap 4. For example, the continuous projection 10 can be a latching hook and improve the hold of the elastomeric cap 4 on the tubular housing section 5.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 Housing
2 Plug connector
3 Plug connector
4 Cap
5 Housing section
6 Terminal contact
7 Sleeve
8 Interference resistor
9 Bead
10 Projection
11 Metal cap
13 Circumferential slot
14 Floor
15 Groove

What is claimed is:

1. An ignition coil for an internal combustion engine, comprising:

a housing having a plug connector;

the plug connector comprising an elastomeric cap disposed on a tubular housing section that surrounds a terminal contact;

a circumferential slot defined by a pair of opposing sidewalls, each of the sidewalls surrounding the terminal contact; and an inner rim of the cap disposed in the circumferential slot.

2. An ignition coil for an internal combustion engine, comprising:

a housing having a plug connector;

the plug connector comprising an elastomeric cap disposed on a tubular housing section that surrounds a terminal contact;

a circumferential slot surrounding the terminal contact;

an inner rim of the cap disposed in the circumferential slot; and wherein the terminal contact sits in an electrically insulating sleeve and the circumferential slot is formed between the electrically insulating sleeve and an inner surface of the tubular housing section.

3. The ignition coil according to claim 2, wherein an interference resistor is arranged in the sleeve.

4. The ignition coil according to claim 2, wherein the sleeve has a bead, which abuts against the tubular housing section on the inside.

5. The ignition coil according to claim 2, wherein the sleeve is press-fitted into the tubular housing section.

6. The ignition coil according to claim 2, wherein the sleeve ends flush with the terminal contact or projects over and beyond it.

7. The ignition coil according to claim 1, wherein the cap fills the circumferential slot essentially completely.

8. The ignition coil according to claim 1, wherein the inner rim of the cap touches a floor of the circumferential slot.

9. The ignition coil according to claim 1, wherein the exterior side of the tubular housing section has a continuous projection engaged in a circumferential groove of the cap.

10. The ignition coil according to claim 9, wherein the continuous projection is a latching hook.

* * * * *